United States Patent [19]
Hahn
[11] 4,271,222
[45] Jun. 2, 1981

[54] PAPERMAKERS FELT AND METHOD OF MANUFACTURE

[75] Inventor: Edward R. Hahn, Neenah, Wis.

[73] Assignee: Albany International Corp., Albany, N.Y.

[21] Appl. No.: 118,494

[22] Filed: Feb. 4, 1980

[51] Int. Cl.[3] ..... B32B 3/00; D04H 1/08

[52] U.S. Cl. ..... 428/193; 162/DIG. 1; 428/60; 428/61; 428/280; 428/311

[58] Field of Search ..... 162/DIG. 1; 139/383 A; 28/110; 428/58, 60, 61, 105, 114, 193, 234, 235, 245, 246, 280, 282, 300, 310, 311

[56] References Cited

U.S. PATENT DOCUMENTS

| | | | |
|---|---|---|---|
| 1,536,533 | 5/1925 | Sheehan | 162/358 |
| 2,038,712 | 4/1936 | Brodin | 428/310 |
| 2,059,132 | 10/1936 | McDermott | 428/235 |
| 3,059,312 | 10/1962 | Jamieson | 428/234 |
| 3,399,111 | 8/1968 | Beaumont et al. | 162/358 |
| 3,617,442 | 11/1971 | Hurschman | 162/348 |
| 3,654,061 | 4/1972 | Berwanger | 428/192 |
| 4,026,747 | 5/1977 | De Lorean et al. | 428/311 |
| 4,224,372 | 9/1980 | Romanski | 428/310 |

*Primary Examiner*—William J. Van Balen
*Attorney, Agent, or Firm*—Kane, Dalsimer, Kane, Sullivan and Kurucz

[57] ABSTRACT

The disclosure is of a composite papermakers felt made up of a textile base layer and an upper layer of a polymeric resin foam. The felt is useful in the wet press section of a papermaking machine. The disclosure is also of a method of manufacturing the felt of the invention.

7 Claims, 5 Drawing Figures

PAPERMAKERS FELT AND METHOD OF MANUFACTURE

BACKGROUND OF THE INVENTION

1. Field of the Invention

The invention relates to papermakers felts and methods of their manufacture and more particularly relates to composite felts comprising a laminate of a textile base and a layer of a flexible, polymeric resin foam. The composite felts of the invention are useful in the press section of a papermaking machine.

2. Brief Description of the Prior Art

The modern papermaker employs a highly sophisticated machine to make paper, which is named rather appropriately a "papermaking machine". The modern papermaking machine is in essence a device for removing water from the paper furnish. The water is removed sequentially in three stages or sections of the machine. In the first or forming section, the furnish is deposited on a moving forming wire and water drained through the wire to leave a paper sheet or web having a solids content of circa 18 to 25 percent by weight. The formed web is carried into a wet press felt section and passed through one or more nip presses on a moving press felt to remove sufficient water to form a sheet having a solids content of 36 to 44 percent by weight. This sheet is then transferred to the dryer section of the papermaking machine where dryer felts press the paper sheet against hot, steam-heated dryer cylinders to obtain about 92 to 96 percent solids content.

The clothing employed on the paper making machine must perform a widely diverse range of functions, according to the position on the machine, i.e.; forming, press or dryer section. In view of the diversity of functions, the clothing for use in each section of the machine must be manufactured to meet specific design requirements essential to the particular section. In the absence of meeting the specific felt design requirements demanded in each section of the machine, the overall operation of the machine will be unsatisfactory. Optimum operating lives of the felts will not be achieved, product quality may be adversely affected, machine speeds may be lowered or drying efficiency may be impeded.

Those skilled in the art have long appreciated that the efficiency of water removal in the wet press section of the papermaking machine is critical to overall efficiency in the papermaking process. This is because, first a large amount of water must be removed from the sheet at the presses to realize a good drying economy. Secondly, greater efficiency in water removal creates a drier and hence stronger sheet less susceptible to breaking. A large variety of clothing constructions have been proposed as papermakers felts advantageously employed in the press section of a papermaking machine. In fact, there has been a continual evolution of clothing constructions, corresponding to improvements in the papermaking machine itself. This evolution began with the early woven felt, woven of spun yarn and then mechanically felted of fulled. A later development was found in the "Batt-on-Base" construction consisting of a woven fabric base and a batt surface attached by needling. The needled batt-on-base felts are widely used today and have been said to be the "standard of the industry". However, a wide variety of other constructions are available, including non-woven press felts.

Important physical properties of a papermakers press felt are measured by four test measurements. They are:

1. Saturated moisture: a measure of the amount of water absorbed by the felt under static conditions. Expressed as pounds of water absorbed per pound of felt, saturated moisture is an excellent indicator of the ability of a felt to receive water from the sheet in the nip.
2. Vacuum dewatering: measures the ability of a felt or fabric running on a press to release water to a suction pipe.
3. Air permeability: measured in a dry felt, is expressed as cfm/sq. ft. of felt at 0.5 in. water pressure ($m^3/m^2$ per hr. at 10 mm water gauge).
4. Flow resistance: the water permeability of the felt or fabric.

Generally, the batt-on-base felts are advantageous in all four parameters, compared to the earlier conventional woven felt. However, as the speed of the papermaking machines has increased, so has the need for press felts which show an advantage in one or more of the desired physical properties.

One type of press felt which has been suggested is a composite of a woven or non-woven fabric base bearing a surface layer of a flexible, open-cell, polymeric resin foam. This layer, acting like a sponge would enhance the removal of water from the paper sheet. In addition, the inherent thermal insulation provided by the foam layer would impart some protection to the underlying fabric structure which is normally exposed completely to the degradative, hot water being pressed from the paper sheet. These composite felts have also shown good resistance to compaction for long periods of time. Representative of the prior art concerned with the latter composite papermakers felts are the disclosures found in U.S. Pat. Nos. 1,536,533; 2,038,712; 3,059,312; 3,399,111; and 3,617,442. In general, the papermakers felts of the prior art which comprise a composite laminate of a textile and a polymeric resin layer have not been completely satisfactory in regard to their resistance to wear and delamination. Apparently, the diverse nature of the two components enhances degradation of the overall composite.

The composite structure of the papermakers felts of the present invention are an improvement over the prior art composite felts in regard to their resistance to wear and delamination. In addition, the method of their manufacture is an improvement over prior art manufacturing processes.

SUMMARY OF THE INVENTION

The invention comprises a papermakers felt, which comprises;

a textile base layer; and an upper layer for receiving a wet paper sheet, affixed to the base layer, said upper layer comprising a plurality of flexible, polymeric resin foam strips having side edges, said strips being laid side by side with abutting side edges with the lengthwise direction of the strips fixed at an angle to the direction of both the machine direction and the cross-machine direction yarns in the base layer.

The invention also comprises the method of fabricating the papermakers felts of the invention.

DETAILED DESCRIPTION OF THE PREFERRED EMBODIMENTS OF THE INVENTION

Figure 1:
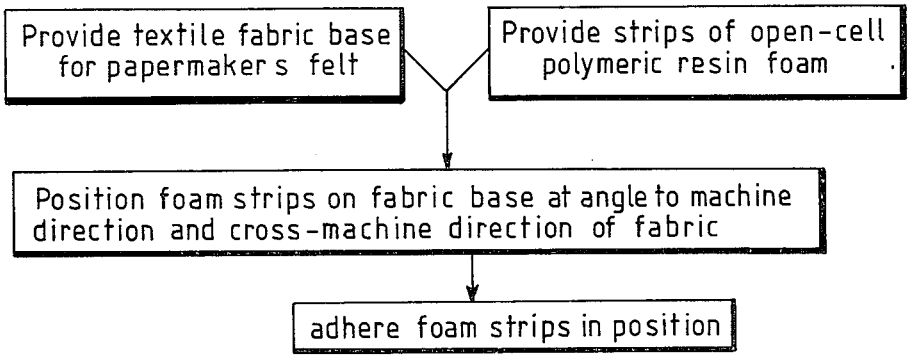
FIG. 1 is a flow diagram illustrating the steps in a preferred embodiment method of fabricating the papermakers felts of the invention.

The papermakers felts of the invention may be fabricated by the steps shown in FIG. 1, a flow diagram of a preferred method. In an initial step, one provides a textile fabric base, which may be a conventional press felt fabric preferably of interwoven machine direction (warp) and cross-machine direction (weft) textile yarns. The yarns may be spun yarns, spun from synthetic or natural staple fibers such as staple fibers of wool, cotton, polyolefins, polyamides, polyesters, mixtures thereof and the like.

The particular weave employed in providing the base fabric is not critical and any conventional felt weave may be employed including a non-woven textile base or a base fabric having only warp or only weft yarns. Thus, the base fabric may also be a single layer or a multi-layered weave construction and may include filling yarns or picks to control permeability of the fabric. In addition, it may be advantageous to provide as the base fabric one which comprises a woven fabric as described above to which there has been needled to one or more surfaces a batt of non-woven staple fibers such as described above. A needled batt-on-base fabric employed as a base layer for the composite felts of the present invention is a preferred construction for optimum strength, stability, water permeability and operating efficiency.

Preferably, the woven and the needled fabrics employed as a base layer to fabricate the composite fabrics of the invention are mechanically felted when provided, so that they are suitable for use as press fabrics without the addition of the polymeric resin layer as will be described hereinafter.

In accordance with the embodiment process shown in FIG. 1, there is also provided strips of flexible, polymeric resin foam such as an open-cell foam of polyurethane. Any other conventional, open cell, flexible polymeric resin foam may be used. Advantageously the strips have a width of about 12 inches and a thickness of about ⅛ to about ¾ inches. In the next step in the method of the invention, the strips of flexible polymeric resin foam are positioned on the paper sheet side or surface of the textile base fabric, at an angle to the machine direction yarns and at an angle to the cross-machine direction yarns of the base fabric. Preferably, the angle in each case is within the range of from about 0.5 to about 30 degrees. With the foam strips in position, side edge to side edge, they are adhered in place to the textile fabric base to form a composite, two component laminate of the foam strips and the base textile fabric.

Figure 2:
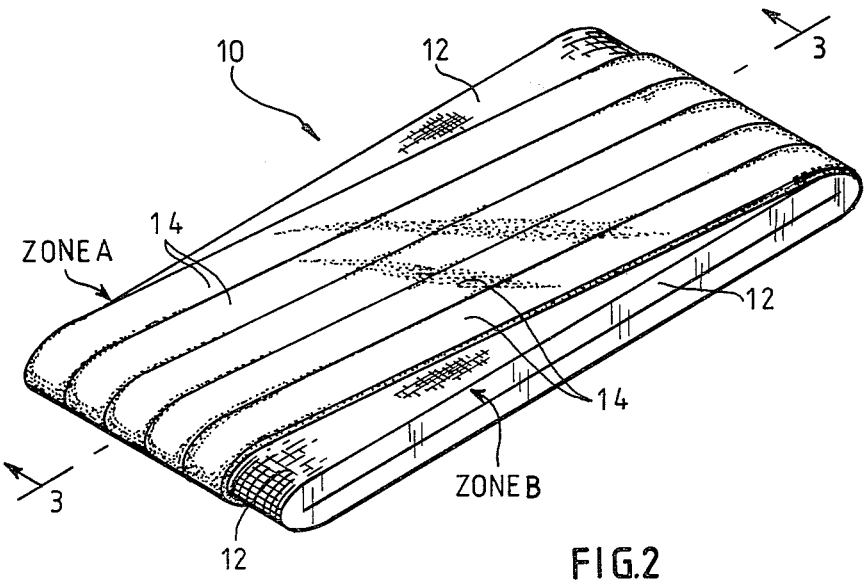
FIG. 2 is a view-in-perspective showing a step in the fabrication of papermakers felts of the invention.

Referring now to FIG. 2, one may see a view in perspective showing a step in the fabrication of a preferred papermakers felt 10 of the invention. In FIG. 2, an endless (either woven endless or woven flat and having the ends joined) textile fabric base layer 12 which comprises a fabric of interwoven, warp and weft spun yarns is collapsed flat against itself as shown in FIG. 2. As also shown in the FIG. 2, the endless belt of layer 12 is overlapped with a continuous strip 14 of a polymeric resin foam, flexible in nature. The flexible strips 14 are wrapped helically about the whole body of the layer 12 at a bias or angle to both the machine direction and the cross-machine direction of the yarns in layer 12, with the side edges of the flexible strips 14 abutting each other. After the entire body of layer 12 (upper and lower) has been overwrapped with strips 14 on the bias, the strips 14 may be affixed and adhered in position on the outer surfaces of the layer 12. Preferably, affixation or adherence is by needling of the flexible foam strips 14 to the base layer 12. Techniques for needling composite structures are so well known that they need not be recited herein; see for example the needling techniques described in U.S. Pat. No. 2,059,132.

Figure 3:
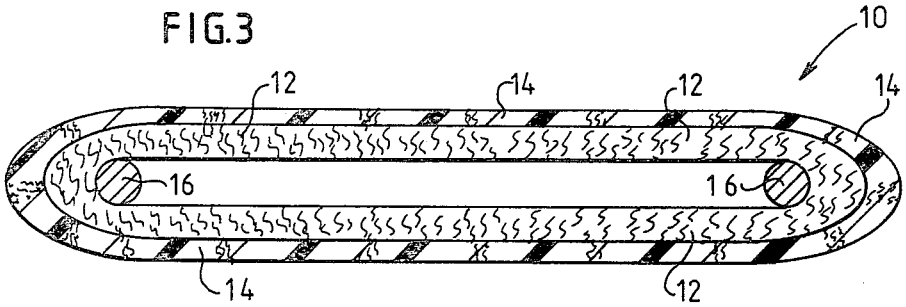
FIG. 3 is a view along lines 3—3 of FIG. 2, but after affixing the foam strips to the textile base fabric.

Following adherence of the strips 14 to the outer surfaces of the layer 12, the side edges of the composite papermakers felt in zones A and B, which remain uncovered by the strip 14, are removed by trimming away (along the machine direction). FIG. 3 is a cross-sectional view along lines 3—3 of FIG. 2 following fixation of the strips 14 to the base layer of fabric 12 by needling and trimming of the edges. The belt may be spread so that it may be supported by rollers 16 as shown in the FIG. 3 (the dimensions of the felt have been exaggerated in FIG. 3, in comparison to rollers 16, for illustrative purposes). It will be appreciated that by needling the strips 14 to the base layer 12, there is a physical engagement between the layer 12 and the strip 14 which resists delamination. Staple fibers forming the structure of layer 12 are drawn vertically into the body of the strips 14 where they engage with and become enmeshed with the foam structure. The vertical alignment of fibers passing from the foam strips 14 into the layer 12 provide a water course for transmission of water from the paper sheet, through the foam strip 14 and through the layer 12.

Figure 4:
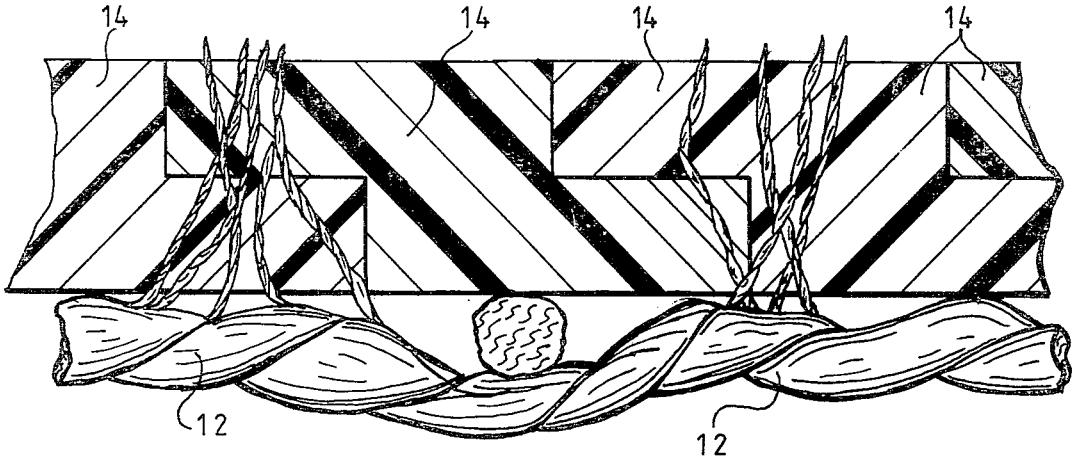
FIG. 4 is a cross-sectional, side elevation of a part of the papermakers felt shown in FIG. 3, enlarged to show details of the foam layer construction.

Referring now to FIG. 4 an enlarged cross-sectional, side elevation of a part of the papermakers felt shown in FIG. 3 may be observed, showing details of the foam layer 14 construction. The foam strips 14 as shown in FIG. 4 have stepped side edges for mating with adjacent strips 14. This particular side abutment construction together with the biased positioning of the strips 14 in respect to the underlying interwoven yarns of the base fabric 12, accounts for a very strong and wear resistant construction, during operation of the fabric on a papermaking machine. As also shown in FIG. 4, the adherence of the fixed strips 14 by needling, brings fibrous material (portions of staple fiber) from the base fabric 12 into the foam structure of strips 14 to reinforce and strengthen it in addition to securing the strips 14 in the base layer 12.

Figure 5:
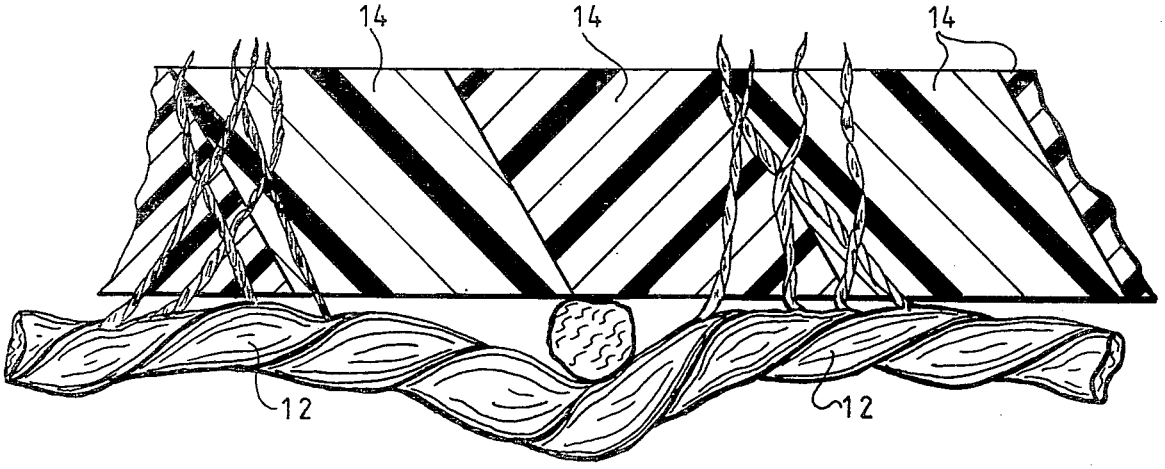
FIG. 5 is a view as in FIG. 4 but of an alternate foam layer construction.

FIG. 5 is a view as seen in FIG. 4, but of an alternate construction wherein the side edges of the strips 14 have been skived for a close abutment of the edges. Skiving of the side edges of the foam strips 14 also provides a strong, wear resistant, lamination strengthening, construction.

What is claimed:

1. A papermakers felt, which comprises;

a textile base layer; and an upper layer for receiving a wet paper sheet affixed to the base layer, said upper layer comprising a plurality of flexible, polymeric resin foam strips having side edges, said strips being laid side by side with abutting side edges and with the lengthwise direction of the strips fixed at an angle to the direction of both the machine direction and the cross-machine direction yarns in the base layer.

2. The felt of claim 1 wherein said base layer also comprises a batt of staple fibers needled to said yarns.

3. The felt of claim 1 wherein said foam is an open cell polyurethane foam.

4. The felt of claim 1 wherein the upper layer is affixed by needling.

5. The felt of claim 1 wherein the abutting side edges are stepped.

6. The felt of claim 1 wherein the abutting side edges are skived.

7. A papermakers felt, which comprises;

a base layer of interwoven, machine direction (warp) and cross-machine direction (weft) textile yarns; and an upper layer for receiving a wet paper sheet affixed to the base layer, said upper layer comprising a plurality of flexible, polymeric resin foam strips having side edges, said strips being laid side by side with abutting side edges and with the lengthwise direction of the strips fixed at an angle to the direction of both the machine direction and the cross-machine direction yarns in the base layer.

* * * * *